United States Patent [19]

Markle et al.

[11] Patent Number: 4,772,765

[45] Date of Patent: Sep. 20, 1988

[54] COMBINED ON/OFF AND REVERSING SWITCH AND ELECTRIC DEVICE THEREWITH

[75] Inventors: Stanley A. Markle, Lutherville; Keith Moore, Randallstown, both of Md.

[73] Assignee: Black & Decker Inc., Newark, Del.

[21] Appl. No.: 13,698

[22] Filed: Feb. 12, 1987

[51] Int. Cl.[4] ..... H01H 9/00

[52] U.S. Cl. ..... 200/1 V; 200/157; 310/50

[58] Field of Search ..... 200/1 V, 157; 310/50

[56] References Cited

U.S. PATENT DOCUMENTS

| | | | |
|---|---|---|---|
| 1,706,483 | 3/1929 | Corbett | 200/157 X |
| 3,161,899 | 12/1964 | Poizat | 15/23 |
| 4,558,189 | 12/1985 | Dibbern, Jr. et al. | 200/1 V |
| 4,678,871 | 7/1987 | Wong | 200/1 V |

*Primary Examiner*—A. D. Pellinen
*Assistant Examiner*—Morris Ginsburg
*Attorney, Agent, or Firm*—Edward D. Murphy; Dennis Dearing; Edward D. C. Bartlett

[57] ABSTRACT

A combined on/off and reversing switch, particularly for an electric screwdriver having a reversible motor, has a switch plate which can be rotatably mounted on an end of the motor. Terminals of the motor extend through the switch plate and are selectively contacted by ends of two resiliently flexible contact strips carried by the switch plate. An actuating member is moved along a selected path to rotate the switch plate to select "forward" and "reverse", and then depressed inwardly to flex an end of the appropriate contact strip to complete energization of the motor. The contact strips resiliently bias the actuating member outwardly to switch the motor "off" when the actuating member is released. Switching the motor "on" from a neutral "off" position of the switch involves a two part movement of the actuating member. The switch is of simple and compact construction.

28 Claims, 2 Drawing Sheets

COMBINED ON/OFF AND REVERSING SWITCH AND ELECTRIC DEVICE THEREWITH

FIELD OF THE INVENTION

This invention relates to an electric switch combining on/off and reversing functions, particularly for operating an electric motor. This invention also relates to the incorporation of this switch into an electric device, particularly a handheld electric tool.

BACKGROUND OF THE INVENTION

It is known to provide portable electric tools with reversing capability, e.g. handheld electric drills, power screwdrivers, etc. In general this has involved employing two switches, one for the reversing function and another for the on/off function. Both switches have separate actuating members which may be adjacent each other or spaced apart at different locations on the tool.

Both these functions have beem combined in a single switch with an actuating member which pivotally rocks, rocking in one direction selecting forward drive and simultaneously switching the motor "on", while rocking in the opposite direction selects reverse drive and simultaneously switches the motor "on". However, such switch has four stationary contacts with associated connecting strips as well as movable contacts, and a rotatable switch plate rotatably connected to a stationary switch plate; such an arrangement is somewhat expensive to manufacture, and is rather bulky. Further, when operating this switch by rocking the actuating member, the operator does not have any positive "feel" of the operating position of the switch.

SUMMARY OF THE INVENTION

This invention is concerned with providing an improved switch combining on/off and reversing functions.

It is an object of the present invention to provide a combined switch in which the "forward" and "reverse" positions are selected by one movement of an actuating member, and then the on/off function is controlled by a different movement of the actuating member.

In the preferred embodiment, this object is achieved by sliding the actuating member along a slot between the "forward" and "reverse" positions, and then depressing the actuating member inwardly to switch "on". This has the advantage of enabling direction selection and on/off control of the switch to be accomplished by one finger of the operator on the actuating member, but discernibly separating the on/off action from the direction selection.

Accordingly, therefore, there is provided by one aspect of the present invention, for an electric device having a reversible electric motor in a housing, switch means in the housing for switching said motor "on" and "off" and for selecting a direction of drive of said motor between "forward" and "reverse", the switch means having an actuating member accessible from externally of the housing for manual actuation of the switch means. The actuating member is movable along a path relative to the housing between a "forward" position and a "reverse" position, the actuating member being movable in a first direction transverse to said path in the "forward" position to switch the motor "on" for forward drive, and the actuating member being movable in a second direction transverse to said path in the "reverse" position to switch the motor "on" for reverse drive.

Preferably, resilient means resiliently bias the actuating member to switch the motor "off" in the "forward" and "reverse" positions.

The switch means may advantageously comprise a rotatably mounted switch plate carrying two resilient contact strips, the contact strips resiliently biasing the actuating member to switch the motor "off" in both the "forward" and "reverse" positions.

Stationary contacts for the switch means may be provided by terminals extending from the motor, for example the spade-like terminals that are provided on small D.C. motors.

Another object of the invention is to provide a simpler and more compact combined function switch. This object is achieved by rotatably mounting the switch plate on a boss at a terminal end of the motor and arranging for terminals of the motor to extend through openings in the switch plate. This has the advantage of only minimally increasing the overall length of the motor and providing a very compact motor/switch arrangement which can employ the motor terminals as stationary contacts.

Preferably, the openings in the switch plate are arcuate apertures, and the motor terminals are engaged by contact ends of the resilient contact strips of the switch plate. Preferably such engagement involves at least some sliding of the contact ends on the motor terminals to minimize corrosion or pitting thereof.

The actuating member may flex free ends of the resilient contact strips to complete energization of the motor when the actuating member is depressed in the selected "forward" or "reverse" position.

The switch means may be incorporated in its own housing as a separate unit, but is preferably incorporated in the housing of an electric device, for example an electric drill. The switch means may advantageously be incorporated in the handle of a palm held cordless screwdriver.

As will be understood from the detailed description subsequently, a preferred embodiment of the switch of the present invention offers convenience in manufacture and assembly, has a compact configuration, offers a reduction in manufacturing cost, allows a shorter tool handle in appropriate end uses, and provides fast operation between "forward" and "reverse" while providing the operator with operational "feel".

Other objects, features and advantages of the present invention will become more fully apparent from the following detailed description of the preferred embodiment, the appended claims and the accompanying drawings.

DETAILED DESCRIPTION OF THE PREFERRED EMBODIMENT

Figure 1:
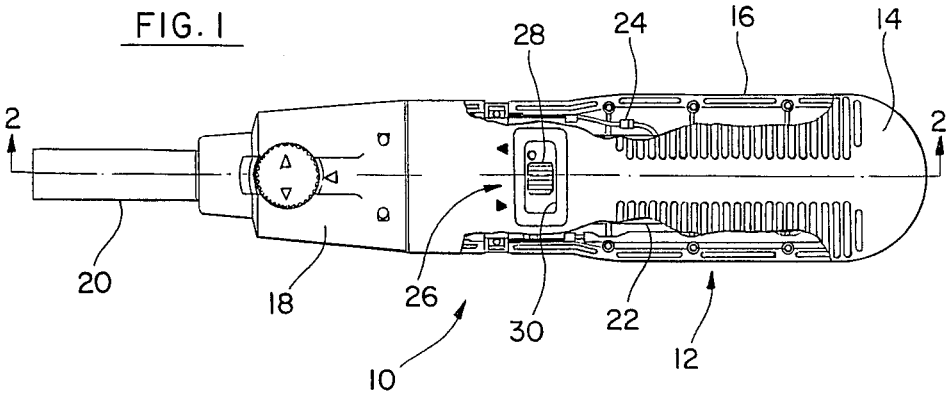
FIG. 1 is a top plan view of a cordless electric screwdriver according to the invention, with some of the tool's housing broken away to expose part of the interior.
Figure 2:
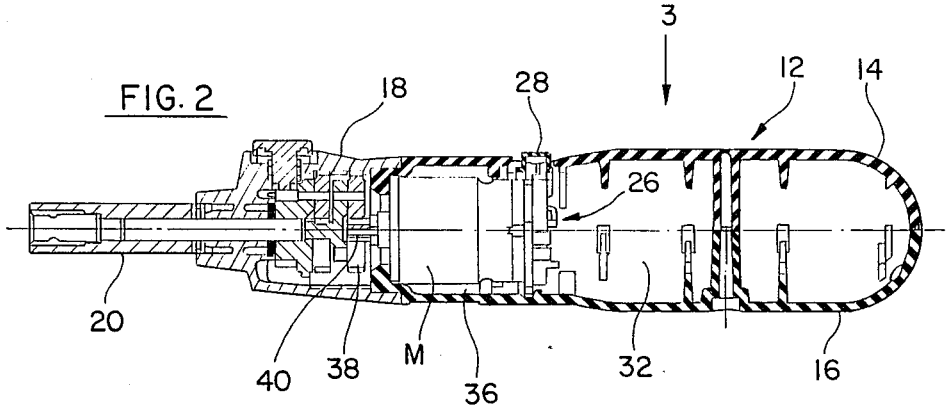
FIG. 2 is a longitudinal section on the line 2—2 of FIG. 1 with the batteries and wiring omitted for simplicity.
Figure 3:
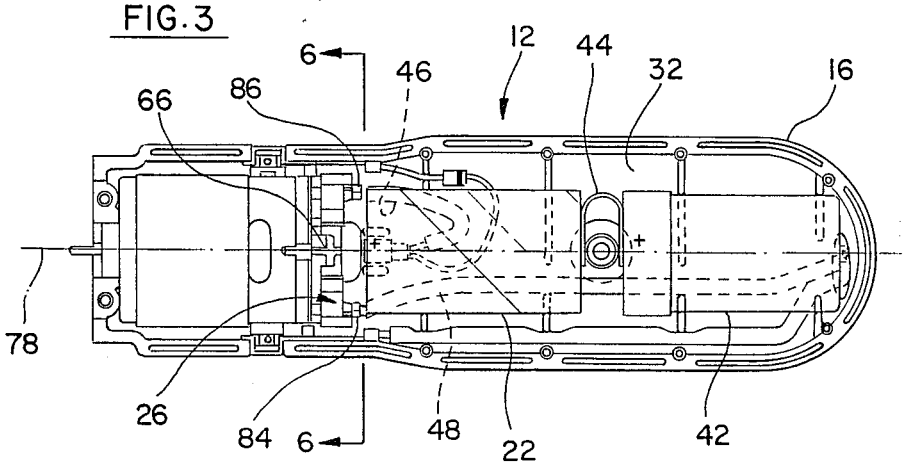
FIG. 3 is a top plan view, in the direction of the arrow 3 in FIG. 2, of the handle portion of the screwdriver with the top clamshell half of the housing and the button removed to show the motor and batteries.
Figure 4:
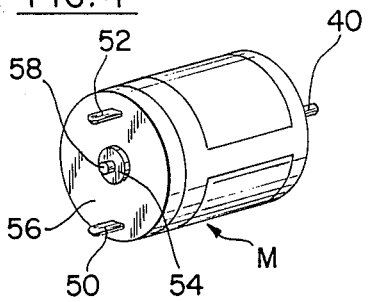
FIG. 4 is a diagrammatic perspective view of the motor of the screwdriver.

FIGS. 1 to 3 illustrate a cordless electric screwdriver according to the invention, and FIGS. 4 to 9 illustrate the construction and operation of the preferred embodiment of a combined on/off and reversing switch according to the invention and which is advantageously incorporated in the screwdriver, FIG. 4 showing a small D.C. motor with which this combined switch is particularly adapted to operate.

FIG. 1 shows in plan view the screwdriver 10 having a main body and handle portion 12 comprising two clamshell type housing parts 14, 16. A gearbox compartment 18 is attached to the forward end of the handle portion 12 with a chuck 20, for holding a screwdriver bit (not shown), extending forwardly therefrom. Portions of clamshell housing part 14 are broken away to expose a rechargeable battery 22 and a wiring connection 24 between electrical components of the tool. The location of a switch 26 is indicated by an arrow. The switch 26 is a combined on/off and reversing switch, and has a manually operable button 28 exposed and accessible through a transverse arcuate opening 30 in the upper clamshell housing part 14 near the front thereof. In use, the handle portion 12 is grasped in one hand with a finger of that hand engaging the button 28 for operation thereof.

FIG. 2 is a section on the line 2—2 of FIG. 1 and shows a battery compartment 32 (with the batteries removed ) in the handle portion 12. A small D.C. motor M, for example operating on 2.4 volts D.C., is housed forwardly of the battery compartment in a motor compartment 36 in the front of the handle portion 12. The switch 26 is disposed between the compartments 32, 36. Reduction gearing 38 of the planetary type is connected between the output shaft 40 of the motor M and the chuck 20 for drivingly rotating the latter.

FIG. 3 is a view of the handle portion 12 in the direction of the arrow 3 in FIG. 2 with the upper clamshell housing part removed to show components inside the handle portion. Two rechargeable nickel/cadmium batteries 22, 42 in the compartment 32 are connected in series via a Ushaped metal contact strip 44. Wiring 46, 48 connects the end poles of the pair of batteries 22, 42 to terminals 84, 86 of the switch 26.

FIG. 4 shows a perspective view of the motor M with the drive shaft 40 extending from the forward end and the two flat, spade-like terminals 50, 52 extending from the rear end. A cylindrical boss 54 protrudes from the center of the rear end wall 56 of the motor, a rear end 58 of the drive shaft being journalled in a bearing in the boss 54. The boss 54 is concentric with the drive shaft 40 and the terminals 50, 52 are disposed on diametrically opposite sides of the boss and adjacent the periphery of the rear end wall 56. The motor M is energized by connecting a 2.4 volt D.C. supply from the batteries 22, 42 across the terminals 50, 52.

Figure 6:
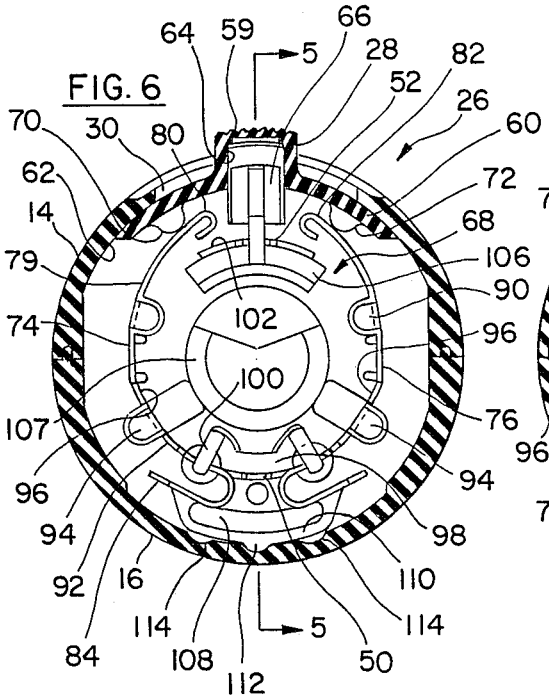
FIG. 6 is a section on the line 6—6 of FIG. 3 with the combined on/off and reversing switch in a neutral position.

FIG. 6 is a cross-section on the line 6—6 of FIG. 3 and shows more details of the switch 26. The actuating button 28 has a serrated upper grip surface 59, and is integrally connected to an arcuate slide 60 which extends beyond the button 28 on each side thereof in the longitudinal direction of the screwdriver. Also, the slide 60 is arcuately longer than the slot 30 in the upper clamshell housing part 14. The button 28 extends upwardly through, and is movable along, the slot 30 with the slide 60 normally engaging and sliding around the inner surface 62 of the upper clamshell part 14. The extent of arcuate movement of the slide 60 is limited by the ends of the slot 30 by abutment thereagainst of the button 28. The button 28 is hollow and has a cylindrical recess or bore 64 therein opening downwards. An upwardly extending, cross-shaped peg 66 (see also FIG. 3), of an oscillatable disc-like switch plate 68 of electrically insulating material, is slidably engaged in the bore 64 and guides the button 28 and slide 60 during downward and upward movement thereof. Adjacent each arcuate end of the slide 60 is an integral, inwardly extending projection 70, 72 having a smoothly curved convex surface which functions as a cam. The two cam-like projections 70, 72 are located on the slide 60 nearer the rear edge thereof, that is the edge nearer the battery compartment 32 than the motor compartment 36 (FIG. 3).

The projections 70, 72 engage respective upper free ends of a pair of resilient conductive strips 74, 76. The strips 74, 76 are made of electrically conductive sheet metal, such as steel or an alloy, and are resiliently deformable to also function as springs. The strips 74, 76 have a lower arcuate portion 77 (see FIG. 7) which is approximately concentric with the rotation axis of the motor shaft 40, which axis is also the central longitudinal axis 78 (see FIGS. 3 and 7) of the screwdriver. The upper arcuate portion 79 of each strip is eccentric to the axis 78 and diverges upwardly and outwardly from the circle on which the lower arcuate portions 77 lie. At the extreme upper ends of the strips 74, 76 are contacts 80, 82 formed by inwardly extending convexly curved ends of the strips. The lower ends of the strips 74, 76 are of U-shape configuration with the outer leg of each U being formed with the rearwardly extending spade-like terminal 84, 86, respectively, and to which opposite end poles of the batteries are connected.

Each strip 74, 76 is supported on the switch plate 68 by posts 90 and 94 extending axially from the plate 68. Each strip 74, 76 extends outside the post 90 and inside post 94. The posts 90 and 94 each have a small flange which engages over the axially rearward edge of the respective strip. Also, each strip has portions 92, 96 which engage the respective post 94 and prevent arcuate movement of the strips relative to the switch plate 68. The switch plate 68 has a lower arcuate wall 98 which prevents radially inward deflection of the U-shaped lower ends of the strips 74, 76; radially outwardly extending legs 100 on the wall 98 engage over the strips 74, 76. In this way, the strips 74, 76 are supported in position on the switch plate 68 for movement therewith, with the upper ends of the strips 74, 76 being free to be deflected inwardly towards the axis 78.

The upper arcuate portions 79 of the strips 74, 76 resiliently bear against the cam-like projections 70, 72 and bias the button 28 upwardly until the slide 60 abuts firmly against the housing inner surface 62, as shown in FIG. 6. In this way, the contact strips 74, 76 jointly function as a spring for normally retaining the button 28 in an upward inoperative position.

The switch plate 68 has upper and lower narrow arcuate apertures 102, 104 (see also FIG. 7) through which slidably extend, respectively, the spade-like terminals 52, 50 of the motor. The lower arcuate wall 98 supports the lower terminal 50 against radially inward deflection, and an upper arcuate wall 106 on the switch plate 68 supports the upper motor terminal 52 against such deflection.

The switch plate has a central hub 107 defining a cylindrical hole therethrough concentric with the axis 78. The hub 107 is rotatably mounted on the boss 54 (see FIG. 4) of the motor. Arcuate movement of the actuating button 28 causes , via the peg 66, rotation of the switch plate 68 about the motor boss 54 within the limits imposed by the ends of the slot 30. In the position shown in FIG. 6, the motor terminal 50 is spaced from and midway between the lower U-shaped ends of the contact strips 74, 76, and the upper motor terminal 52 is disposed midway between the upper strip contacts 80, 82 with these contacts 80, 82 being spaced radially outwardly of the terminal 52. This is the neutral and "off" position of the switch 26 with no electrical connection between the contact strips 74, 76 and the motor terminals 50, 52. If the button 28 is manually depressed in this position, the cam-like projections 70, 72 will slide on and flex the resilient upper portions 79 of the strips 74, 76 inwards towards the axis 78, but the contacts 80, 82 will not contact the upper motor terminal 52.

Figure 7:
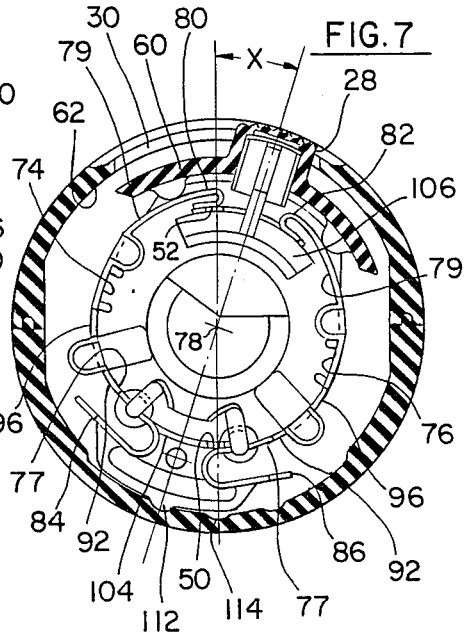
FIG. 7 is a similar view to FIG. 6 with the combined switch "on" and in the position for forward drive as when inserting a screw.

However, when the button is moved to the right in FIG. 6, the slide 60 rotates approximately 18 degrees clockwise through the angle x until the button reaches the right-hand end of the slot 30. In this new position, when the button 28 is depressed, the contacts 80, 82 are moved radially inward until the contact 80 engages the upper motor terminal 52 and presses it against the upper arcuate wall 106—as shown in FIG. 7. In reaching the position in FIG. 7, the lower U-shaped end of the right-hand strip 76 rides over and in contact with the radially outer surface of the lower motor terminal 50, this terminal 50 being resiliently clamped between the lower arcuate wall 98 and the lower contact end of the strip 76. In the FIG. 7 position, the motor terminals 50, 52 are electrically connected across the end poles of the batteries via the contact strips 74, 76. FIG. 7 illustrates the forward position of the switch 26 with the switch "on", i.e. the motor M is energized to rotate in the forward direction of drive such as when inserting a screw with the screwdriver. In this forward position, if the button 28 is released, the reiliency of the deformed contact strips 74, 76 will urge the button 28 radially outwards so disconnecting the contact 80 from the motor terminal 52; this de-energizes the motor M even though the button 28 is in the forward position, i.e. the switch is then in a forward drive but "off" position.

When the button 28 is manually slid counterclockwise so the lefthand end of the slot 30, i.e. through an angle 2x from the position in FIG. 7, the reverse position of the switch 26 is obtained. In the reverse position, the lower contact of the lefthand strip 74 engages over the lower motor terminal 50, and the upper contact 82 of the righthand strip 76 is positioned in register with the upper motor terminal 52. When the button 28 is inwardly depressed in this reverse position, the contact 82 engages the motor terminal 52 to energize the motor in the reverse direction of drive, for example for removing screws with the screwdriver. Again, in this reverse position, as soon as the button 28 is released, the button is moved radially outwardly by the "spring" formed by the upper strip portions 79 to de-energize the motor, i.e. the switch 26 occupies a reverse drive but "off" position.

The lower portion of the switch plate 68 is provided with a downward extension having an arcuate opening 108 therein to provide a resiliently deformable arcuate member 110. A radially outwardly extending pip 112 is formed at the mid-point of the arcuate member 110. Three adjacent detent notches 114 are formed in the inside wall of the lower clamshell part 16. When the switch plate 68 is rotated by arcuate movement of the button 28, the pip 112 moves from engagement in one detent notch 114 to another due to the resilient inward flexing of the member 110. The pip 112 and the detents 114 function to releasably latch the switch plate in the forward, neutral and reverse positions of the switch 26. This has the advantage of providing a more positive feel of the position of the switch.

Figure 5:
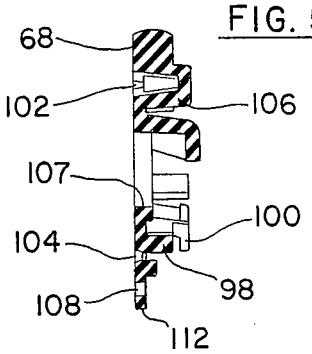
FIG. 5 is a section on the line 5—5 of FIG. 6 of a disc-like member of the combined on/off and reversing switch of the invention.

FIG. 5 is a cross-section on a smaller scale of the switch plate 68 on the line 5—5 of FIG. 6, and shows further details thereof including the relative positions of the upper and lower arcuate walls 106, 98, the hub 107, the radially outward extending leg 100, and the pip 112.

Figure 8:
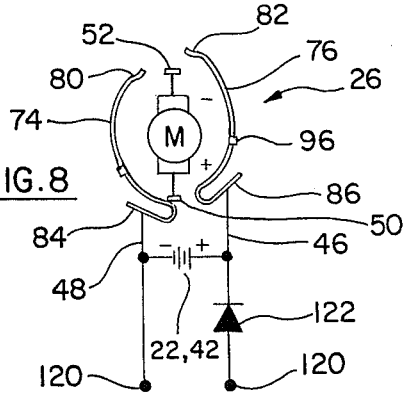
FIG. 8 is a circuit schematic of the screwdriver of FIG. 1 with the movable contacts of the combined switch of FIG. 6 in the "off" and reverse drive position.
Figure 9:
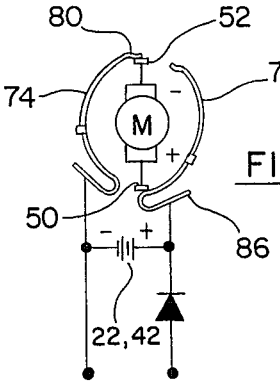
FIG. 9 is the circuit schematic of FIG. 8 but with the movable contacts of the combined switch in the "on" and forward drive position of FIG. 7.

FIGS. 8 and 9 are similar electrical schematic diagrams of the screwdriver, but with the switch 26 in different positions. The screwdriver is provided with a pair of battery recharging terminals 120 which are connected across the batteries 22, 42 via a diode 122. Opposite end poles of the batteries are connected via wires 48, 46 to terminals 84, 86, respectively, of the contact strips 74, 76. The motor M is illustrated diagrammatically with its terminals 50, 52. FIG. 8 represents the reverse position of the switch when the button 28 is moved counterclockwise in FIG. 6 and released. Although the lower contact end of strip 74 makes contact with the lower motor terminal 50, both upper contacts 80, 82 are spaced from the other motor terminal 52 so that the switch is "off". FIG. 9 represents the position of the switch 26 shown in FIG. 7, i.e. the forward "on" position; as can be seen, current is supplied to the motor M via the lower terminal 50 and leaves via the upper terminal 52.

In operation, the operator grasps the handle portion 12 in one hand, and with a finger of that hand arcuately moves the button 28 to the right or left (FIG. 6) to move the switch 26 to the forward or reverse position, respectively. Then, in the selected position, the button 28 is depressed to energize the motor M in the selected direction. The motor only remains energized while the button 28 is manually held depressed; as soon as the finger releases the button 28, the motor is de-energized. If the button is depressed in the neutral position midway between the forward and reverse positions, the motor is not energized.

It will be appreciated, therefore, that a combined on/off and reversing switch is provided having only a single actuating button. Movement of the button along one path changing the switch between forward and reverse positions through a neutral position, and movement in a direction transverse to said one path switching "on" and "off" when in either the forward or reverse position. This provides simple one finger control of the combined switch and the feature of automatically switching "off" the instant downward pressure of the finger on the button is released. Further, when the button is depressed by the finger to switch "on", this finger action tends to increase the user's single handed grip of the screwdriver for surer use.

It will also be appreciated that the illustrated switch is of simple construction with a minimum of parts, particularly moving parts, and is relatively easy to assemble. Both these features help reduce production cost.

Further, mounting the oscillatable switch plate directly on an end face of the motor, via the motor boss 54, enables a very compact switch construction to be obtained. In the illustrated preferred embodiment, the switch and motor M form a combination the axial length of which exceeds the axial length of the motor M by only a short distance, approximately 4 mm. The economy of occupied space enables the length of the main body and handle portion of the tool to be reduced. Further, it enables the actuating button 28 of the switch to be readily located at the commencement of the handle portion for convenient finger operation.

As mentioned above, the detent arrangement between the switch plate and the housing enables the switch to be positively located in the neutral, forward and reverse positions in a manner which gives a "feel" to the user of positive switching. This is advantageous when manipulating the actuating button to different positions with one finger, particularly when the finger remains continuously on the actuating button or other suitable actuating member.

It should be noted that in the preferred embodiment, the contacts engage the motor terminals with a sliding action. The sliding action is more pronounced with engagement of the lower motor terminal. With the upper motor terminal there is first a direct contact action, but then as the upper portions of the contact strips are further flexed downwards, a sliding action occurs. This is advantageous as the sliding action tends to clean the contacting surfaces of the contacts and the terminals, and inhibits build-up of any corrosion; it also minimizes the effect of any pitting. Advantageously, the actuating button can be arranged to have an extent of travel during full depression which results in a definite amount of "over travel". This will cause additional flattening of the upper curved portion of each contact strip after the upper contact thereof has engaged the upper motor terminal; thus, additional sliding motion will occur between the contact and the terminal. Further, the contact will be held more firmly against the terminal.

The above described embodiments, of course, are not to be construed as limiting the breadth of the present invention. Modifications, and other alternative constructions, will be apparent which are within the spirit and scope of the invention as defined in the appended claims.

What is claimed is:

1. An electric device, comprising:

a housing;

a reversible electric motor mounted in said housing;

switch means, in said housing, for switching said motor "on" and "off" and for selecting a direction of drive of said motor between "forward" and "reverse";

said switch means having an actuating member accessible from externally of said housing for manual actuation of said switch means;

said actuating member being movable along a first path relative to said housing between a "forward" position and a "reverse" position, said "forward" and "reverse" positions being distinctly spaced apart a predetermined distance and defining ends of said first path;

said actuating member, when in said "forward" position, being movable along a second path extending in a straight line transverse to said first path to effect switching "on" of said motor for forward drive; and said actuating member, when in said "reverse" position, being movable along a third path also extending in a straight line transverse to said first path to effect switching "on" of said motor for reverse drive.

2. The device of claim 1, further comprising resilient means for resiliently biasing said actuating member to switch said motor "off" in said "forward" and "reverse" positions.

3. The device of claim 1, wherein said first path is defined by a slot in said housing through which said actuating member extends outwardly and is movable along, and said actuating member is depressible inwardly through said slot to move along said second and third paths to switch said motor "on" when said actuating member is in said "forward" and "reverse" positions, respectively.

4. The device of claim 3, wherein said actuating member is located at opposite ends of said slot in said "forward" and "reverse" positions, and said actuating member occupies a "neutral" position intermediate said "forward" and "reverse" positions, depression of said actuating member inwardly of said housing in said "neutral" position not switching said motor "on".

5. The device of claim 1, wherein said switch means comprises a rotatably mounted switch plate carrying two resilient contact strips, said contact strips resiliently biasing said actuating member to switch said motor "off" in both said "forward" and "reverse" positions.

6. An electric device, comprising:

a housing;

a reversible electric motor mounted in said housing;

switch means, in said housing, for switching said motor "on" and "off" and for selecting a direction of drive of said motor between "forward" and "reverse";

said switch means having an actuating member accessible from externally of said housing for manual actuation of said switch means;

said actuating member being movable along a path relative to said housing between a "forward" position and a "reverse" position;

said actuating member being movable transversely to said path in said "forward" position to switch said motor "on" for forward drive;

said actuating member being movable transversely to said path in said "reverse" position to switch said motor "on" for reverse drive;

said switch means comprising a rotatably mounted switch plate carrying two resilient contact strips, said contact strips resiliently biasing said actuating member to effect switching of said motor "off" in both said "forward" and "reverse" positions; and said motor having an end wall with a boss extending centrally therefrom, said switch plate engaging over and being rotatably mounted on said boss, and terminals of said motor extending through arcuate openings in said switch plate for selective engagement with said contact strips by actuation of said actuating member.

7. An electric device, comprising:

a housing containing a reversible electric motor;

a switch plate rotatably mounted on an end of said motor;

said switch plate carrying two resilient contact members;

an actuating member connected to said switch plate and extending outwardly through a slot in said housing, said actuating member being slidable a predetermined distance along said slot, sliding of said actuating member along said slot rotating said switch plate between "forward" and "reverse" positions;

a pair of terminals extending from said motor;

said actuating member being depressible inwardly through said slot in said "forward" and "reverse" positions of said switch plate to deform said contact members and establish selective connection of said contact members with said terminals to switch said motor "on" respectively in forward and reverse directions of drive;

such inward depression of said actuating member not rotating said switch plate; and said contact members resiliently biasing said actuating member outwardly through said slot to effect switching of said motor "off" when said switch plate is in said "forward" and "reverse" positions.

8. An electric device, comprising:

a housing containing a reversible electric motor;

a switch plate rotatably mounted on an end of said motor;

said switch plate carrying two resilient contact members;

an actuating member connected to said switch plate and extending outwardly through a slot in said housing, movement of said actuating member along said slot rotating said switch plate between "forward" and "reverse" positions;

a pair of terminals extending from said motor;

said actuating member being depressible inwardly through said slot in said "forward" and "reverse" positions to deform said contact members and establish selective connection of said contact members with said terminals to switch said motor "on" in either selected direction of drive;

said contact members resiliently biasing said actuating member outwardly through said slot to effect disconnection of said selective connection and switch said motor "off" in said "forward" and "reverse" positions; and said end of said motor comprising an end wall with a boss extending therefrom, a drive shaft of said motor being journalled in said boss, said switch plate being rotatably mounted on said boss, and said terminals being disposed on opposite sides of said boss and extending through openings in said switch plate.

9. The device of claim 7, wherein each said contact member comprises a curved metal strip with contacts at opposite ends thereof, rotation of said switch plate to said "forward" and "reverse" positions connecting a first contact of one contact member with one of said terminals and placing a second contact of the other contact member in register with but spaced from the other of said terminals, depression of said actuating member effecting connecting of said second contact with said other of said terminals.

10. An electric device, comprising:

a housing containing a reversible electric motor;

a switch plate rotatably mounted on an end of said motor;

said switch plate carrying two resilient contact members;

an actuating member connected to said switch plate and extending outwardly through a slot in said housing, movement of said actuating member along said slot rotating said switch plate between "forward" and "reverse" positions;

a pair of terminals extending from said motor;

said actuating member being depressible inwardly through said slot in said "forward" and "reverse" positions to deform said contact members and establish selective connection of said contact members with said terminals to switch said motor "on" in either selected direction of drive;

said contact members resiliently biasing said actuating member outwardly through said slot to effect disconnection of said selective connection and switch said motor "off" in said "forward" and "reverse" positions; and said switch plate being rotatable about a rotational axis of said motor, each contact member having a curved portion which is concentric to said axis and another curved portion which is eccentric to said axis, depression of said actuating member flexing said eccentric portion towards said axis.

11. An electric device, comprising:

a housing containing an electric motor capable of operating in forward and reverse directions of drive;

a switch actuating member having a slide slidably engaged with an inner wall of said housing, and a manually operable button extending outwardly from said slide through a slot in said housing, said button being movable along said slot between "forward" and "reverse" positions;

said button also being depressible through said slot to space said slide away from and inwardly of said inner wall;

a switch plate rotatably mounted in said housing and carrying two resilient contact strips having first and second contacts at opposite ends;

said actuating member slidably engaging with said switch plate to enable rotation of said switch plate by said actuating member when said button moves between said "forward" and "reverse" positions but allowing movement of said actuating member relative to said switch plate inwardly and outwardly with respect to said housing;

two terminals connected to said motor;

one of said terminals being slidably engaged by the first contact of a respective one of said contact strips upon rotation of said switch plate to a respective one of said "forward" and "reverse" positions but the second contact of the respective other of said contact strips being spaced from the other of said terminals; and depression of said button in said "forward" and "reverse" positions causing said slide to flex portions of said contact strips and bring said second contact of the respective other of said contact strips into engagement with said other of said terminals to energize said motor and effect operation thereof in said forward and reverse directions of drive, respectively.

12. The device of claim 11, wherein said contact strips remain in engagement with said slide and resiliently bias said slide towards engagement with said inner wall to deenergize said motor when said button is released by an operator in said "forward" and "reverse" positions.

13. The device of claim 12, wherein each contact strip has a portion adjacent one end which is concentric with an axis about which said switch plate is rotatable and a portion adjacent the other end which is eccentric to said axis, said concentric portion being restrained against flexing by posts extending from said switch plate but said eccentric portion being free to flex, depression of said button flexing said eccentric portion towards a configuration which is concentric with said axis.

14. An electric reversing switch, comprising:

a housing having a slot in a wall thereof;

a disc-like switch plate of electrically insulating material mounted in said housing for rotation about an axis and having a peg extending transversely away from said axis towards said slot;

an actuating member for one finger manual actuation of the switch, said actuating member comprising a slide inside said housing adjacent said slot and a button extending outwardly from said slide through said slot;

said button having a cavity therein open towards said axis and said peg being slidably engaged in said cavity, movement of said button along said slot rotating said switch plate between "forward" and "reverse" positions;

a "neutral" position of said switch plate between said "forward" and "reverse" positions;

a pair of electrically conductive contact strips mounted on said switch plate on opposite sides of said axis for movement with said switch plate about said axis;

said contact strips being resiliently flexible, and an end portion of each contact strip between said axis and said slot being free to flex towards said axis;

each said contact strip end portion resiliently urging said slide outwardly with respect to said housing against said wall;

a stationary terminal contact mounted in said housing, said terminal contact extending between the contact strip end portions but being spaced therefrom towards said axis when said slide is urged against said wall and said switch plate is in said "neutral" position;

the end portion of one of said contact strips being in register with but spaced outwardly from said terminal contact in said "forward" position, and the end portion of the other of said contact strips being in register with but spaced outwardly from said terminal contact in said "reverse" position; and said contact strip end portions being flexed inwards towards said axis by said slide when said button is manually depressed towards said axis, when said button is so depressed said end portions not making contact with said terminal contact in said "neutral" position but the end portion of said one contact strip making contact with said terminal contact in said "forward" position and the end portion of said other contact strip making contact with said terminal contact in said "reverse" position.

15. An electric portable tool, comprising:

a housing having a slot in a wall thereof;

a reversible electric motor in said housing;

an electric reversing switch for controlling operation of said motor; and said reversing switch comprising:

a disc-like switch plate of electrically insulating material mounted in said housing for rotation about an axis and having a peg extending transversely away from said axis towards said slot;

an actuating member for one finger manual actuation of the switch, said actuating member comprising a slide inside said housing adjacent said slot and a button extending outwardly from said slide through said slot;

said button having a cavity therein open towards said axis and said peg being slidably engaged in said cavity, movement of said button along said slot rotating said switch plate between "forward" and "reverse" positions;

a "neutral" position of said switch plate between said "forward" and "reverse" positions;

a pair of electrically conductive contact strips mounted on said switch plate on opposite sides of said axis for movement with said switch plate about said axis;

said contact strips being resiliently flexible, and an end portion of each contact strip between said axis and said slot being free to flex towards said axis;

each said contact strip end portion resiliently urging said slide outwardly with respect to said housing against said wall;

a stationary terminal contact mounted in said housing, said terminal contact extending between the contact strip end portions but being spaced therefrom towards said axis when said slide is urged against said wall and said switch plate is in said "neutral" position;

the end portion of one of said contact strips being in register with but spaced outwardly from said terminal contact in said "forward" position, and the end portion of the other of said contact strips being in register with but spaced outwardly from said terminal contact in said "reverse" position;

said contact strip end portions being flexed inwards towards said axis by said slide when said button is manually depressed towards said axis, when said button is so depressed said end portions not making contact with said terminal contact in said "neutral" position but the end portion of said one contact strip making contact with said terminal contact in said "forward" position and the end portion of said other contact strip making contact with said terminal contact in said "reverse" position; and said terminal contact comprising a first terminal of said motor, said motor having a second terminal and both said terminals extending through arcuate apertures in said switch plate.

16. The switch of claim 14, further comprising detent means, operative between said switch plate and said housing, for locating and releasably holding said switch plate against rotation in said "forward", "neutral" and "reverse" positions.

17. The switch of claim 16, wherein said detent means comprises a pip resiliently mounted on said switch plate and a plurality of cavities in said housing wall, said pip engaging in a different one of said cavities in each of said positions.

18. A cordless electric screwdriver, comprising:

a housing having a motor compartment and a battery compartment;

a reversible D.C. motor in said motor compartment and having a pair of spade-like terminals extending from an end thereof;

at least one rechargeable battery in said battery compartment;

an on/off and reversing switch disposed between said motor and battery compartments;

an arcuate slot in an upper side of said housing extending in a direction transverse to a longitudinal direction of said housing;

an actuating member extending through and movable along said slot;

said switch including a plate rotatably mounted on said end of said motor and carrying a pair of elongate resiliently flexible contact strips, opposite ends of said strips being selectively engageable with said terminals upon appropriate actuation of said actuating member;

said actuating member being slidably connected to said plate to allow depression of said actuating member through said slot to flex said contact strips;

said depression of said actuating member not effecting rotation of said plate, the rotation of said plate being effected only by movement of said actuating member along said slot;

said rotation of said plate selectively connecting a lower end of one of said strips with one of said terminals, and when so connected downward depression of said actuating member flexing an upper end of another of said strips into contact with the other of said terminals; and resilient means for urging said actuating member upwardly to disconnect said other of said terminals.

19. The screwdriver of claim 18, wherein said resilient means comprises upper portions of said strips.

20. The screwdriver of claim 19, further comprising detent means for locating and releasably retaining said plate, upon rotation, in forward, neutral and reverse positions, depression of said actuating member in said neutral position not effecting contact of either contact strip with said other terminal.

21. The screwdriver of claim 18, wherein said contact strips are electrically connected respectively to opposite poles of said battery.

22. A cordless electric screwdriver, comprising:

a housing having a motor compartment and a battery compartment;

a reversible D.C. motor in said motor compartment and having a pair of spade-like terminals extending from an end thereof;

at least one rechargeable battery in said battery compartment;

an on/off and reversing switch disposed between said motor and battery compartments;

an arcuate slot in an upper side of said housing extending in a direction transverse to a longitudinal direction of said housing;

an actuating member extending through and movable along said slot;

said switch including a plate rotatably mounted on said end of said motor and carrying a pair of elongate resiliently flexible contact strips, opposite ends of said strips being selectively engageable with said terminals upon appropriate actuation of said actuating member;

said actuating member being slidably connected to said plate to allow depression of said actuating member through said slot to flex said contact strips, movement of said actuating member along said slot effecting rotation of said plate;

said rotation of said plate selectively connecting a lower end of either strip with one of said terminals, and when so connected downward depression of said actuating member flexing an upper end of the other of said strips into contact with the other of said terminals;

resilient means for urging said actuating member upwardly to disconnect said other of said terminals;

said contact strips being electrically connected respectively to opposite poles of said battery;

said terminals extending through and beyond arcuate apertures in said plate; and arcuate walls extending from said plate and adjacent said terminals to support said terminals against deflection when engaged by said contact strips.

23. An electric device, comprising:

a housing;

a reversible electric motor mounted in said housing;

switch means for selecting a direction of drive of said motor between forward and reverse directions of drive, and for switching said motor "on" and "off";

said switch means having an actuating member accessible from externally of said housing for manual actuation of said switch means;

said actuating member being manually displaceable relative to said housing along a path between "neutral", "forward" and "reverse" positions which are spaced apart with said "neutral" position being intermediate and distinctly spaced from said "forward" and "reverse" positions, said motor normally being switched "off" when said actuating member is in said "neutral", "forward" and "reverse" positions;

said actuating member being manually depressible inwardly relative to said housing in said "forward" and "reverse" positions to effect switching "on" of said motor and effect drive thereof in said forward and reverse directions of drive, respectively; and said switch means being incapable of switching "on" said motor by any depression of said actuating member when said actuating member is in said "neutral" position.

24. The electric device of claim 23, further comprising latching means for releasably latching said actuating member against movement along said path when said actuating member is in said "neutral" position.

25. The electric device of claim 24, wherein said latching means also functions to releasably latch said actuating member in each of said "forward" and "reverse" positions while still allowing manual depression of said actuating member in said "forward" and "reverse" positions to effect said switching "on" of said motor.

26. An electric device, comprising:

a housing;

a reversible electric motor mounted in said housing;

switch means for respectively selecting forward and reverse directions of drive of said motor, and for switching said motor "on" in either selected direction of drive;

said switch means including a switch plate rotatably mounted in said housing, and an actuating member accessible from externally of said housing for manual actuation of said switch means;

said actuating member being slidable along a slot in said housing between "neutral", "forward" and "reverse" positions, said "neutral" position being between and spaced from said "forward" and "reverse" positions;

said actuating member being connected to said switch plate and sliding of said actuating member along said slot effecting rotation of said switch plate;

said actuating member being manually depressible inwardly with respect to said housing, any such inward depression not effecting rotation of said switch plate;

said switch means functioning to effect switching "on" of said motor when said actuating member is so manually depressed inwardly with respect to said housing in said "forward" and "reverse" positions to effect forward and reverse drive, respectively, of said motor; and said switch means functioning to prevent switching "on" of said motor by any depression of said actuating member when in said "neutral" position.

27. The electric device of claim 26, further comprising releasable latching means for automatically latching said actuating member against sliding movement along said slot when said actuating member is in said "neutral" position.

28. An electric device, comprising:

a housing;

a reversible electric motor mounted in said housing;

switch means, in said housing, for switching said motor "on" and "off" and for selecting a direction of drive of said motor between "forward" and "reverse";

said switch means having an actuating member extending outwardly through said housing for manual actuation of said switch means;

said actuating member being movable along a path relative to said housing between distinct "forward" and "reverse" positions spaced apart along said path;

said actuating member being movable inwardly into said housing when in said "forward" position to switch said motor "on" for forward drive;

said actuating member being movable inwardly into said housing when in said "reverse" position to switch said motor "on" for reverse drive; and latching means for releasably latching said actuating member against movement along said path when said actuating member is respectively in said "forward" and "reverse" positions.

* * * * *